United States Patent [19]

Power

[11] Patent Number: 4,542,804

[45] Date of Patent: Sep. 24, 1985

[54] BOSUN CHAIR SUPPORT APPARATUS

[76] Inventor: Donald L. Power, 4460 E. 68th Ave., Commerce City, Colo. 80022

[21] Appl. No.: 585,896

[22] Filed: Mar. 2, 1984

[51] Int. Cl.[4] ..... A62B 1/16

[52] U.S. Cl. ..... 182/38; 182/3; 182/150

[58] Field of Search ..... 182/142, 38, 59, 60, 182/17, 3, 150

[56] References Cited

U.S. PATENT DOCUMENTS

| | | | |
|---|---|---|---|
| 1,423,998 | 7/1922 | Camp | 182/38 |
| 1,711,354 | 4/1929 | King | 182/60 |
| 2,585,763 | 2/1952 | Gasner | 182/17 |
| 3,491,851 | 1/1970 | Dutcher | 182/142 |

*Primary Examiner*—Reinaldo P. Machado

*Attorney, Agent, or Firm*—Head, Johnson & Stevenson

[57] ABSTRACT

A manually portable, movable, bosun chair support apparatus comprising: a frame member with rollers mounted to the underside which rests on the top ledge of a building wall; an adjustable U-shaped member with arms extending downwardly, one on the inside and the other on the outside of the building wall; a first and second adjustable roller means operatively attached to each of said downwardly extending arms such as to make contact and roll along the inside and the outside of the building wall, respectively; and a hook means attached to the lower end of the outside arm for tieing a rope thereto. Such an apparatus is useful for suspending a workman seated in a bosun chair tied to the apparatus without making permanent or damaging contact with the roof of the building, yet affording the workman ease of movement along the exterior wall of the building as well as affording essentially instantaneous manual installation, removal and repositioning.

2 Claims, 6 Drawing Figures

BOSUN CHAIR SUPPORT APPARATUS

BACKGROUND OF THE INVENTION

1. Field of the Invention

This invention relates to an improved bosun chair support apparatus. More specifically, this invention relates to a manually portable bosun chair support apparatus capable of moving along the top perimeter of a high-rise building while supporting a window washer or the like seated in a bosun chair suspended from the movable apparatus.

2. Description of the Prior Art

Usually during the course of washing the windows of a high-rise building, either a scaffold supported at each end by a pair of cables attached to booms anchored to the roof of the building or a bosun chair tied to a lever arm beam extending over the roof with appropriate counterweights is employed to raise and lower workmen along the exterior wall of the building. Both of these conventional techniques are labor intensive in that every time a job is started or finished a considerable expenditure of time and effort to install and remove the boom, scaffold and/or counterweights is involved. Also, repositioning such apparatus along the top of the building in order to access the entire exterior of the building is also time consuming and inconvenient, but necessary. To further complicate and detract from the desirability of using the conventional techniques, contemporary neoprene and other ultra-thin synthetic polymeric roof coatings require minimizing the installation and movement of heavy equipment on the roof.

SUMMARY OF THE INVENTION

In view of the difficulties associated with the conventional methods and equipment for suspending a workman on the exterior of a high-rise building, I have discovered an improved movable bosun chair support apparatus comprising:

(a) a frame member with a plurality of roller means mounted to the underside of the frame, wherein the frame member is adapted to straddle and rest on the top ledge of a building wall such that the roller means allows the frame to move along the top ledge of the building wall;

(b) an adjustable U-shaped member operatively attached to the frame member wherein the arms of the U-shaped member extend downwardly from the frame member below the top ledge of a building wall on which the frame member moves such that one of the arms is on the inside and the other of the arms is on the outside of the building wall and wherein the adjustable U-shaped member operatively moves the downwardly extending arms toward and away from each other;

(c) a first adjustable roller means operatively attached to the downwardly extending arms on the inner surface of the building wall such that the first roller means is adjustably positioned against the inner wall of the building during use;

(d) a second adjustable roller means operatively attached to the downwardly extending arms on the outer surface of the building wall such that the roller means is adjustably positioned against the outer wall of the building during use; and (e) a hook means operatively attached to the support apparatus for tieing a rope thereto.

The present invention further provides that the first adjustable roller means is adapted to swivel to and lock in a position, when not in use, such that the first adjustable roller means makes contact with the ground or floor, thus allowing the support apparatus to be manually portable in a dolly-like fashion. Preferably, the adjustable U-shaped member is a worm gear and manual crank means that operatively adjusts the distance between the downwardly extending arms to insure simultaneous rolling contact with both the inside and outside of the building wall.

It is an object of the present invention to provide an improved bosun chair support apparatus that is manually portable, easy to install and remove from the top parapet or ledge of a high-rise building wall and manually roll along the top parapet wall, thus supporting a window washer or other workman tied or tethered to the apparatus without making damaging contact to the roof of the building. It is a further object of the present invention to provide such a device that when not in use converts to a dolly-like structure for ease of transportation and storage. Fulfillment of these objects and the presence and fulfillment of additional objects will be apparent upon complete reading of the specification and claims taken in conjunction with the attached drawings.

DESCRIPTION OF THE PREFERRED EMBODIMENTS

Figure 1:
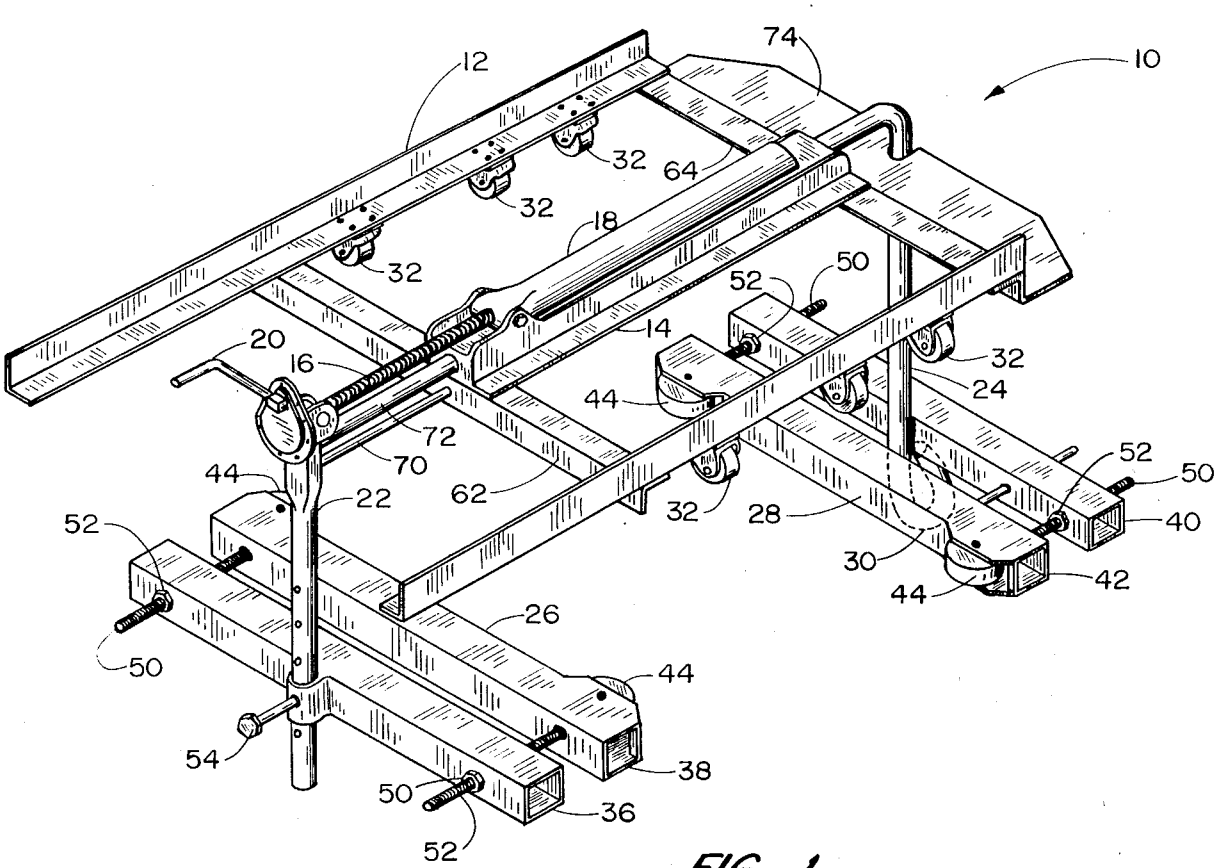
FIG. 1 illustrates a perspective view of the improved movable bosun chair support apparatus according to the present invention.

The improved bosun chair support apparatus according to the present invention, how it is manufactured and operated, how it differs from the conventional prior art apparatus and the advantages of using the device can perhaps best be explained and understood by reference to the accompanying drawings. In FIG. 1, a perspective view of the improved, manually portable, movable, bosun chair support apparatus (generally designated by the numeral 10) is presented illustrating the overall structural elements making up the device according to the present invention.

As illustrated in FIG. 1, the overall support apparatus or device 10 is made up of a horizontal frame 12 (which in this particular embodiment is fabricated from angle iron in a box-like structure), an adjustable U-shaped means 14 (consisting in this embodiment of a worm gear 16 with housing 18, hand crank 20 and two downwardly extending arms 22 and 24), a pair of wall engaging adjustable roller means 26 and 28 and a hook element 30. The horizontal frame member 12 has attached to its underside a series or plurality of roller means or casters 32 which serve as the primary load bearing mechanism during use of the device 10. In other words, and as shown in the cut-away side view of FIG. 4A, the support apparatus 10 is intended to straddle the upper parapet wall or top ledge 34 of a building with the casters 32 on the underside of frame 12 resting directly on top of the ledge 34. In this manner, the entire device 10 is capable of rolling along the top of the wall of the building without making contact with the roof surface of the building.

As further illustrated in FIG. 1, the frame member 12 has an adjustable U-shaped means 14 that is attached to the central portion of the frame 12 between the casters 32. This U-shaped member 14 is equipped with a pair of downwardly extending arms or members 22 and 24 and (in this specific embodiment) a worm gear and housing adjustment is present between the arms 22 and 24 such that the distance between the members 22 and 24 can be operatively selected to fit the width of the building wall. Thus, for purposes of this invention, the phrase "U-shaped" generally refers to any structure that involves a cross-sectional resemblance to a true U-shape in that the outer members extend downwardly along the inside and outside of the parapet wall. Similarly, the concept of adjustability associated with the U-shaped means for purposes of this invention refers to the concept of moving the respective inner and outer downwardly projecting members relative toward or away from the inner and outer surfaces of the wall which is being straddled by the apparatus. As such, the downwardly extending arms can essentially be any arbitrary shape or size consistent with functionally supporting the roller means 26 and 28 or their equivalent. Similarly, the adjustable means can be arbitrarily any structure that functionally allows the respective arms to move from one arbitrary fixed spacing to another fixed spacing and be held selectively at either. Consequently, for purposes of this invention, the preferred worm gear, housing and handle can be replaced by cooperative sliding surfaces or pieces (e.g., concentric pipes, complementary profiles or the like) with locking or fastening means (e.g., bolt and nut, retractable pin, or the like ) passing through each. Other structures equivalent to the worm gear would include by way of example, but not limited thereto, a pawl and ratchet mechanism, hydraulic cylinder, various level arm mechanisms or other similar devices as well known in the art.

FIG. 1 also illustrates the adjustable roller means 26 and 28 which in the illustrated embodiment involves a pair of tubular support elements 36 and 38 for adjustable roller means 26 and tubular support elements 40 and 42 for adjustable roller means 28. In each of these devices 26 and 28, the inner tubular members 38 and 42 are equipped with casters 44 which make contact with the inner parapet wall surface 46 and outer parapet wall surface 48 (see FIG. 4A) during use, such that the entire device is capable of rolling along the top of the building wall. These inner caster containing members 38 and 42 are adjustable in that they are threadably mounted to the outer tubular support elements 36 and 40 by a series of threaded rods 50 with retaining nuts 52. By repositioning the nuts 52 along the threaded rods 50, the relative degree of extension or retraction of the rollers 44 from the respective arms 22 and 24 can be adjusted. In this manner, the support apparatus 10 can be used on a variety of parapet wall cross-sectional geometries including adjustment for overhanging ledge caps and the like. Also, this adjustment is useful to insure good contact with both the inner and outer wall surface and hence, increases stability during use.

Figure 5:
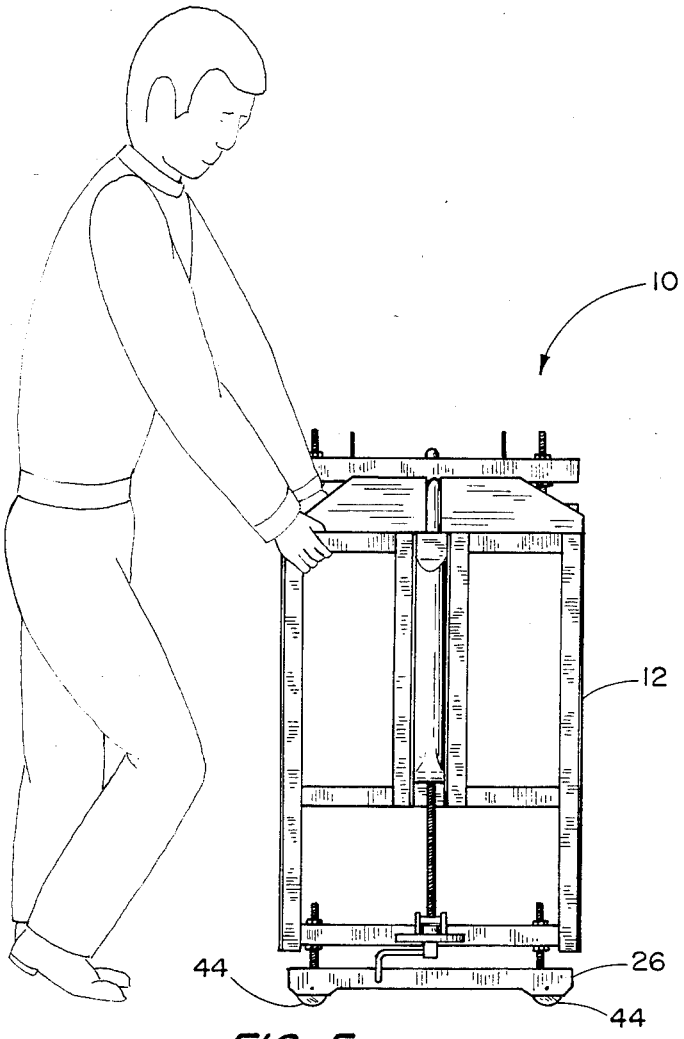
FIG. 5 illustrates the manual portability of the bosun chair support apparatus of FIG. 1 when not in use.

The outer adjustable roller means 28, in the illustrated embodiment, is mounted permanently to the arm 24 by welding the tubular member 40 directly above the hook 30. The inner adjustable roller means 26 is adjustably mounted to the arm 22 by a locking bolt or pin 54 inserted into one of several holes 56 vertically displaced along arm member 22. This further adjustment feature associated with the inner roller means 26 contributes two additional benefits to the use of the device 10. First, it affords the operator the ability to adjust the inner rollers 44 to an optimum depth according to the particular parapet wall to which the device 10 is intended to rest such that maximum leverage consistent with keeping the device on the wall can be achieved. Second, the series of holes 56 and pin 54 allow the entire roller means 26 to swivel 180° around arm 22 and relock with the rollers 44 pointing in the opposite direction. In this manner, the entire support apparatus 10 can be inverted and manually rolled on casters 44 in a dolly-like fashion as illustrated in FIG. 5.

Again, the adjustable roller members 26 and 28 can be generally any device or structure that attach to the downwardly extending arms of the U-shaped adjustable member and that afford selectable positioning and movement toward and away from the arms. Thus, for purposes of this invention, the phrase adjustable roller means generally refers to the concept of being able to adjust for parapet wall or ledge overhang as well as wall thickness. As such, various equivalent geometries and structures can be readily substituted for the illustrated adjustable tubular elements without departing from the spirit and scope of the present invention. It should be further appreciated that the method of adjustment (e.g., threaded rod with retaining nuts) for the adjustable roller means as well as the method of connecting the adjustable roller means to the arms can be generally by any technique or device as well known in the art.

Figure 2:
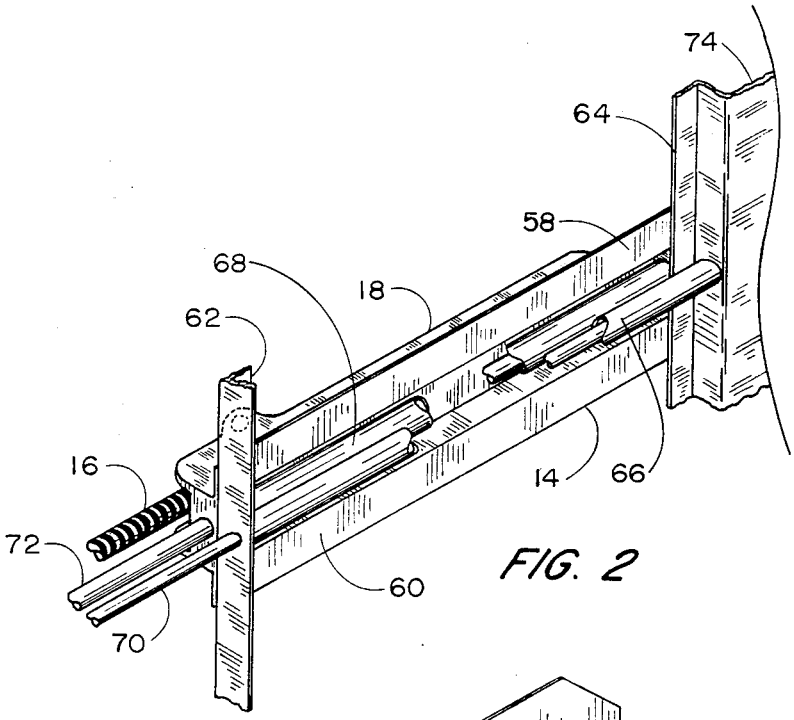
FIG. 2 illustrates a partial cut-away view of the underside of the improved movable bosun chair support apparatus of FIG. 1.
Figure 3:
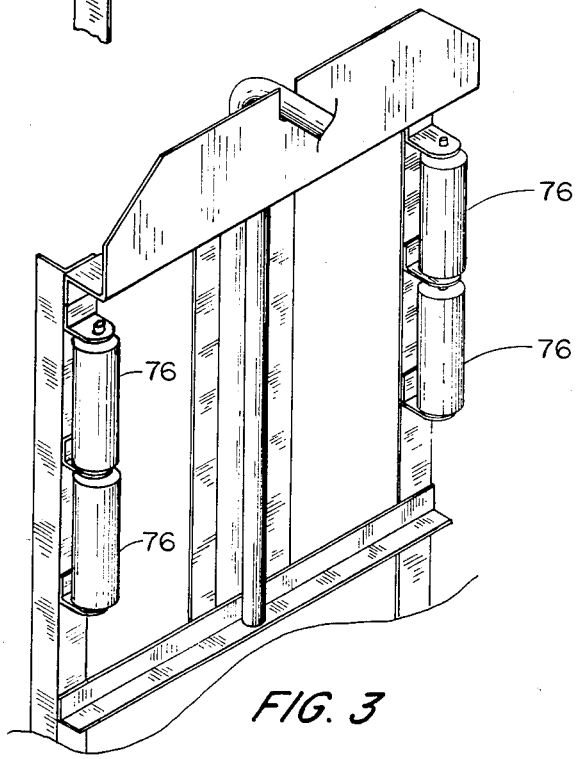
FIG. 3 illustrates a partial cut-away view of the underside of an alternate embodiment of the support apparatus according to the present invention.
Figure 4A:
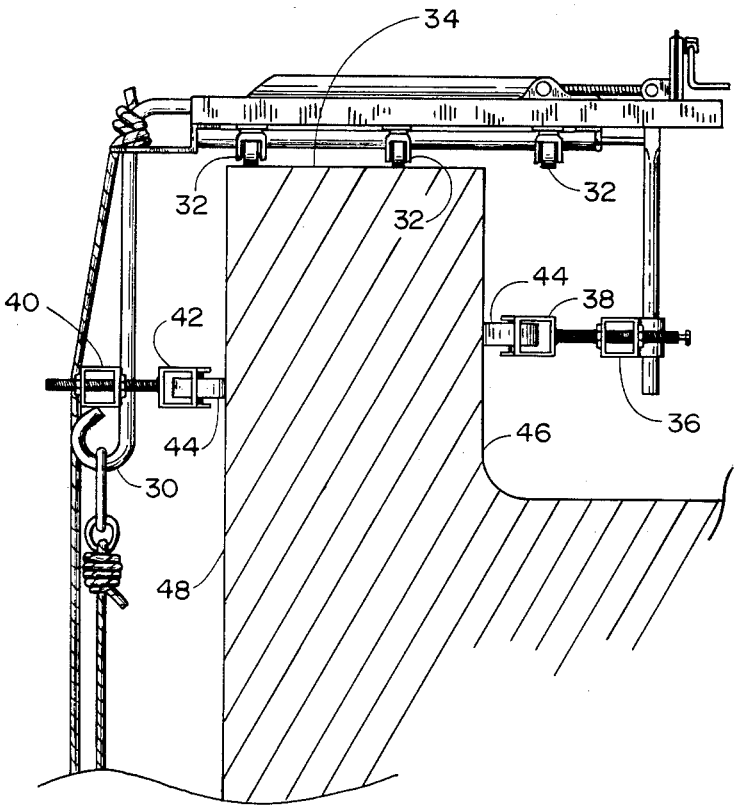
FIGS. 4A and 4B illustrate the bosun chain support apparatus of FIG. 1 mounted to the top ledge of a building with a workman seated in a bosun chair suspended from the support apparatus.

FIG. 2 illustrates the underside of the worm gear mechanism 16 with housing 18 of the adjustable U-shaped member 14. As indicated, housing 18 is mounted directly to a pair of angle iron support arms 58 and 60 which are connected to the inner 62 and outer 64 members of frame 12. Also passing between the frame members 62 and 64 are a pair of colinear alignment tubes 66 and 68 with concentrically contained alignment rods 70 and 72. As the worm gear 16 is threaded into and/or out of housing 18 the alignment rods 70 and 72 slip in and out of the alignment tubes 66 and 68, thus creating the adjustment of the distance between the downwardly extending arms 22 and 24. The presence of the concentrically engaged tubes with rods inherently maintains the arms 22 and 24 in the desired downward vertical position during use of the support apparatus 10. As seen in FIGS. 1 and 2, the outer edge of frame 12 (i.e., member 64) contains a stabilizer plate 74 which assists in maintaining the alignment and stability of the overall device during use. The junction of the stabilizer plate 74 and arm 24 further serves as a convenient location for tieing an additional rope as illustrated in FIG. 4A. FIG. 3 illustrates an alternate embodiment of the underside of frame 12 wherein the previous casters 32 are replaced by a plurality of rollers 76. It should be appreciated that other equivalent roller means can be readily substituted for the specifically illustrated casters and as such, should be considered equivalent for purposes of this invention.

Figure 4B:
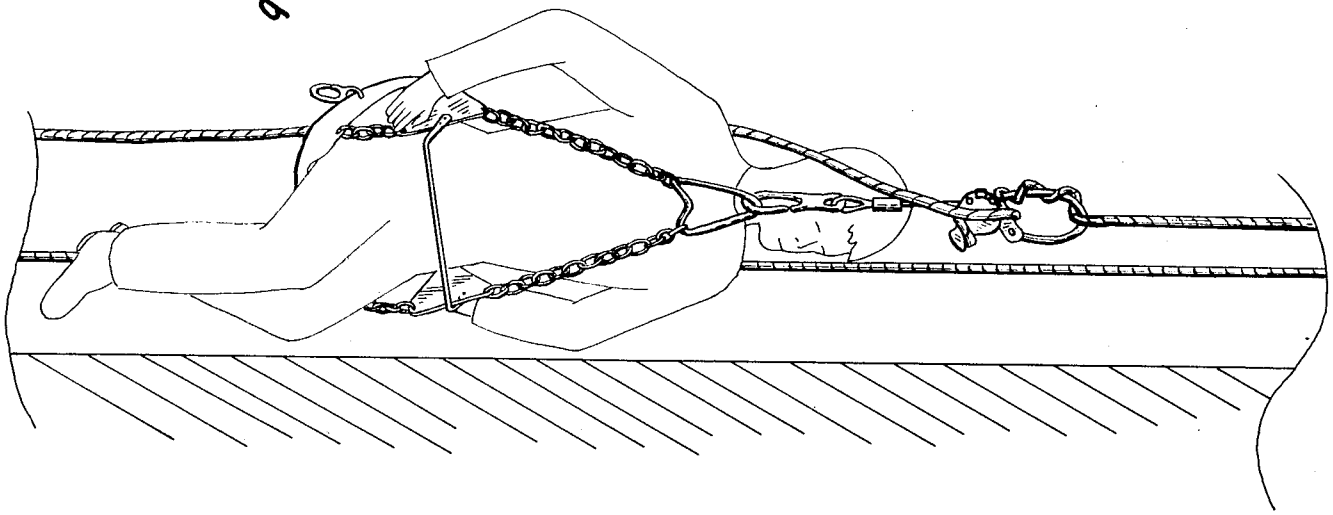

FIGS. 4A and 4B illustrate a cut-away side view of a workman seated in a conventional bosun chair 78 with ancillary equipment being suspended via rope 80 connected to hook 30 of support apparatus 10 straddling the building wall. As shown, an additional rope 82 is tied to the arm member 24 to assist the workman in maneuvering along the exterior wall of the building. Experience indicates that the device as essentially shown in FIGS. 4A and 4B can be readily and easily propelled manually by the workman horizontally along the outside of a floor of the building and once one floor of windows are washed, the workman can then lower himself to the next floor such as to cover an entire exterior face of the building. Of course, it should be appreciated that electric lifts and winches can readily be employed between the workman seated in the bosun chair and the improved movable support apparatus 10 on the roof without significantly changing the overall setup. It should also be appreciated that various safety or backup precautions can be readily employed with the present invention without detracting or significantly altering the overall system and associated advantages. Thus, the additional use of a tether or safety rope can be employed on the roof to anchor or tie the support apparatus 10 directly to a convenient and appropriate object on the roof.

The improved bosun chair according to the present invention can be generally assembled or manufactured out of any conventional material by any of the methods well known in the art. Preferably, the device is assembled out of steel tubing, angle iron or plate wherein the joints and connections are welded and/or bolted to insure adequate strength; however, other high strength, lightweight material should be considered equivalent for purposes of this invention. The overall device is further contemplated to be compatible with manual as well as electric bosun chair lifting mechanisms and can also be powered electrically to facilitate the desired lateral rolling movement along the top ledge of the building wall. However, the entirely manual operated embodiment of the device as exemplified herein is felt to be entirely adequate, convenient and fully functional for such operations as window washing and the like. In fact, it has been the inventor's experience that an apparatus essentially as disclosed in the drawings and as described in the specification was used on a five story building by one man wherein the device was installed, 792 pieces of glass were washed, and subsequently removed within a six and a half hour period (an accomplishment heretofore considered impossible using known devices and technology). Similarly, the four walls of a nine story high-rise building wherein each wall was 24 windows wide were washed by a single workman in a period of six and a half hours. And, in one application of the present invention, 418 windows were washed in one hour and ten minutes by a single workman; while installation and removal of the device has been accomplished in only six minutes.

The advantages of using the improved bosun chair support apparatus according to the present invention and its versatility in terms of useful applications and methods of use are considered to be numerous. Generally, the device is envisioned as being useful for high-rise buildings or the equivalent wherein the sidewalls of the building terminate at the top in a parapet or capped ledge wall structure with an essentially flat surface. The device is felt to be useful on essentially any wall thickness from as narrow as about four inches to dimensions as wide as about eighteen inches or even greater. Furthermore, the device can be easily engineered or designed to accommodate arbitrarily any height of building with seventeen floors or more vertical distances being easily achieved. Thus, the device is also contemplated as being useful for supporting a single bosun chair for purposes of painting, sand blasting, caulking, deglazing, sign painting, sign repair, metal cleaning, brick cleaning, or the like as well as the conventional window cleaning. The device is also contemplated as being adaptable for use in pairs such as to support a scaffolding or the like.

With respect to advantages of using the support apparatus according to the present invention, the device is economical to manufacture and maintain involving a capital expenditure well below the conventional equipment generally employed in the window washing industry. Furthermore, the device is lightweight and highly portable; thus reducing significantly the downtime associated with installation, repositioning and removal from the building as well as transportation and storage between jobs. Furthermore, the device is highly versatile in that one unit will readily accommodate, adjust to or be compatible with a variety of building sizes, configurations and heights. And, the device has proven to be extremely efficient, highly reliable and most importantly, safe during actual commercial use conditions.

Having thus described the preferred embodiments with a certain degree of particularity, it is manifest that many changes can be made in the details of construction, arrangement and fabrication of the elements and their use without departing from the spirit and scope of this invention. Therefore, it is to be understood that the invention is not limited to the embodiments set forth herein for purposes of exemplification, but is to be limited only by the scope of the attached claims, including a full range of equivalents to which each element thereof is entitled.

I claim:

1. A manually portable, movable, bosun chair support apparatus comprising:

(a) an open rectangular frame member with a plurality of roller means mounted to the underside of at least two opposite edges of said open rectangular frame, wherein said frame member is adapted to straddle and rest on the top ledge of a building wall such that said roller means allows said open rectangular frame to move along the top ledge of the building wall;

(b) an adjustable worm gear and crank means operatively attached to said open rectangular frame member such as to rest perpendicular to the top of the building wall when said open rectangular frame member straddles and rests on the top ledge of the building wall and wherein said adjustable worm gear and crank means further consist of a first and second vertical arm attached to opposite ends of said worm gear and crank means and extending downwardly from said open rectangular frame member below the top ledge of the building wall on which said frame member moves such that one of said arms is on the inside and the other on the outside of the building wall thus forming a generally U-shaped worm gear adjustable member wherein rotating said worm gear means operatively moves said downwardly extending arms toward or away from each other;

(c) a first adjustable horizontal member with a plurality of rollers on one side, wherein said first horizontal member is operatively attached to one of said downwardly extending arms on the inner surface of the building wall such that said plurality of rollers are directed towards said building wall and said horizontal members with rollers are adjustable up and down said inner arm and adjustable towards and away from said inner arm;

(d) a second adjustable horizontal member with a plurality of rollers on one side, wherein said second horizontal member is operatively attached to the other of said downwardly extending arms on the outer surface of the building wall such that said plurality of rollers are directed towards said building wall and are adjustable towards and away from said outer arm; and (e) a hook means operatively attached to the lower end of said outer arm for attaching a rope or the like thereto.

2. A bosun chair support apparatus of claim 1 wherein said first adjustable roller means is further adapted to swivel to and lock in position, when not in use, such that said first adjustable roller means makes contact with the ground or floor allowing said support apparatus to be manually portable.

* * * * *